US006688689B1

(12) United States Patent
Thorn

(10) Patent No.: US 6,688,689 B1
(45) Date of Patent: Feb. 10, 2004

(54) MULTIPLE DEGREE OF FREEDOM SEAT SUSPENSION SYSTEM

(75) Inventor: Richard P. Thorn, Erie, PA (US)

(73) Assignee: Lord Corporation, Cary, NC (US)

( * ) Notice: Subject to any disclaimer, the term of this patent is extended or adjusted under 35 U.S.C. 154(b) by 0 days.

(21) Appl. No.: 09/339,366

(22) Filed: Jun. 24, 1999

(51) Int. Cl.[7] ..... A47C 1/02

(52) U.S. Cl. ..... 297/314; 297/313; 297/302.1; 297/325; 248/632

(58) Field of Search ..... 297/314, 325, 297/313, 302.1; 248/618, 632

(56) References Cited

U.S. PATENT DOCUMENTS

| | | | | |
|---|---|---|---|---|
| 2,460,596 A | | 2/1949 | Roche | |
| 2,685,425 A | * | 8/1954 | Wallerstien | 248/632 X |
| 3,309,137 A | * | 3/1967 | Wiebe | 297/325 X |
| 4,640,548 A | * | 2/1987 | Desanto | 297/303.3 |
| 4,789,203 A | * | 12/1988 | Van Zee et al. | 297/316 X |
| 4,826,247 A | | 5/1989 | McGrady et al. | 297/314 |
| 4,852,943 A | * | 8/1989 | Roper | 297/325 |
| 5,295,755 A | | 3/1994 | DeHaan, III et al. | |
| 5,577,803 A | | 11/1996 | Guilbaud | 297/314 |
| 5,649,740 A | * | 7/1997 | Hodgdon | 297/303.3 |
| 5,735,511 A | | 4/1998 | Stocker et al. | |
| 5,769,492 A | | 6/1998 | Jensen | 297/314 |
| 6,019,422 A | * | 2/2000 | Taormino et al. | |

FOREIGN PATENT DOCUMENTS

| | | |
|---|---|---|
| DE | 89 14 349.3 | 3/1990 |
| DE | 295 20 899 U1 | 8/1996 |
| EP | 0772 986 A1 | 5/1997 |

* cited by examiner

*Primary Examiner*—Anthony D. Barfield
(74) *Attorney, Agent, or Firm*—Edward F. Murphy, III

(57) ABSTRACT

A seat suspension system includes a first seat (e.g., a base) member and a second seat (e.g., a seat) member preferably overlying the first seat member. At least one spring (e.g., elastic or rubber) mount is interposed between the first and second seat member. The at least one elastic mount provides a projected elastic center spaced from (preferably located above) the second seat member such that the second seat member is pivotable about the projected elastic center. Embodiments describing seat suspension systems having a single focalized mount or a plurality of spaced apart, focalized mounts are included.

1 Claim, 5 Drawing Sheets

MULTIPLE DEGREE OF FREEDOM SEAT SUSPENSION SYSTEM

FIELD OF THE INVENTION

The present invention relates to seating apparatus, and, more particularly, to a multiple degree of freedom seat suspension system.

BACKGROUND OF THE INVENTION

Conventional seating devices providing multiple degrees of freedom often include a seat support allowing for fore and aft pivoting. Typically, the seat frame is joined to an underlying base support such that the seat frame may mechanically pivot about an axis extending across the width of the seat. The pivot axis is below the seat surface. Pivoting a seat of this design may give the user an unnatural or unbalanced sensation.

While seats have been developed having various mechanical means for providing multiple degrees of freedom, such seats generally suffer from high cost and complexity and/or fail to fully provide the desired degree of comfort and ergonomics. In particular, most chairs typically are not provided with side to side pivoting freedom of motion. Moreover, mechanical pivoting arrangements often suffer from wear, noise, and/or frictional problems, particularly after they have been in service for some time.

SUMMARY OF THE INVENTION

The present invention is directed to a multiple degree of freedom seat suspension system and a seat assembly including the same. The seat suspension system provides a seat that has improved comfort and ergonomics. Moreover, seats employing the suspension system may be constructed with relatively low cost and complexity.

More particularly, the present invention is directed to a seat suspension system including a base member and a seat member overlying the base member. At least one elastic mount is interposed between the base member and the seat member. The at least one elastic mount provides a projected elastic center located above the seat member such that the seat member is pivotable about the projected elastic center. Preferably, the seat suspension system includes a plurality of spaced apart, focalized elastic mounts. However, it should be recognized that a single mount with a projected elastic center may be employed as well. Preferably, the projected elastic center substantially coincides with a user's hip pivot.

According to a further aspect of the present invention, a seat assembly includes a seat suspension system as just described. The seat assembly further includes a base support connected to and underlying the base member of the suspension system.

According to a further aspect of the present invention, a seat suspension system includes a base member and an overlying seat member. A plurality of spaced apart and focalized elastic mounts are interposed between the base and seat members. The elastic mounts provide a projected elastic center located above the seat member such that the seat member is pivotable about the projected elastic center. The seat suspension system allows the seat member to move with multiple degrees of freedom with respect to the base member.

According to a another aspect of the present invention, a seat assembly includes a seat member and a base support connected to, and underlying, the seat member. At least one elastic mount is interposed between the seat member and the base support such that the seat member is pivotable about a pivot point located above the seat member.

In a further aspect of the present invention, a seat suspension system includes a first seat member including a contact surface on a user contact side adapted for being in operable contact with a user; a second seat member spaced from the first seat member; and an elastic mount interconnecting the first and second seat members. The elastic mount provides a projected elastic center spaced from the contact surface on the user contact side such that the seat member is pivotable about the projected elastic center.

According to another aspect of the present invention, the seat suspension system includes a first seat member; a second seat member spaced from the first seat member; and at least one elastic mounting interconnecting the first and second seat members. The least one elastic mount includes a mounting plane defined by a geometrical plane intersecting the center of the at least one mounting. The at least one mounting includes a projected elastic center spaced from the mounting plane such that the first seat member is pivotable about the projected elastic center.

Further objects, features, and details of the present invention will be appreciated by those of ordinary skill in the art from a reading of the figures and the detailed description of the preferred embodiments which follow, such description being merely illustrative of the present invention.

DETAILED DESCRIPTION OF THE PREFERRED EMBODIMENTS

Figure 1:
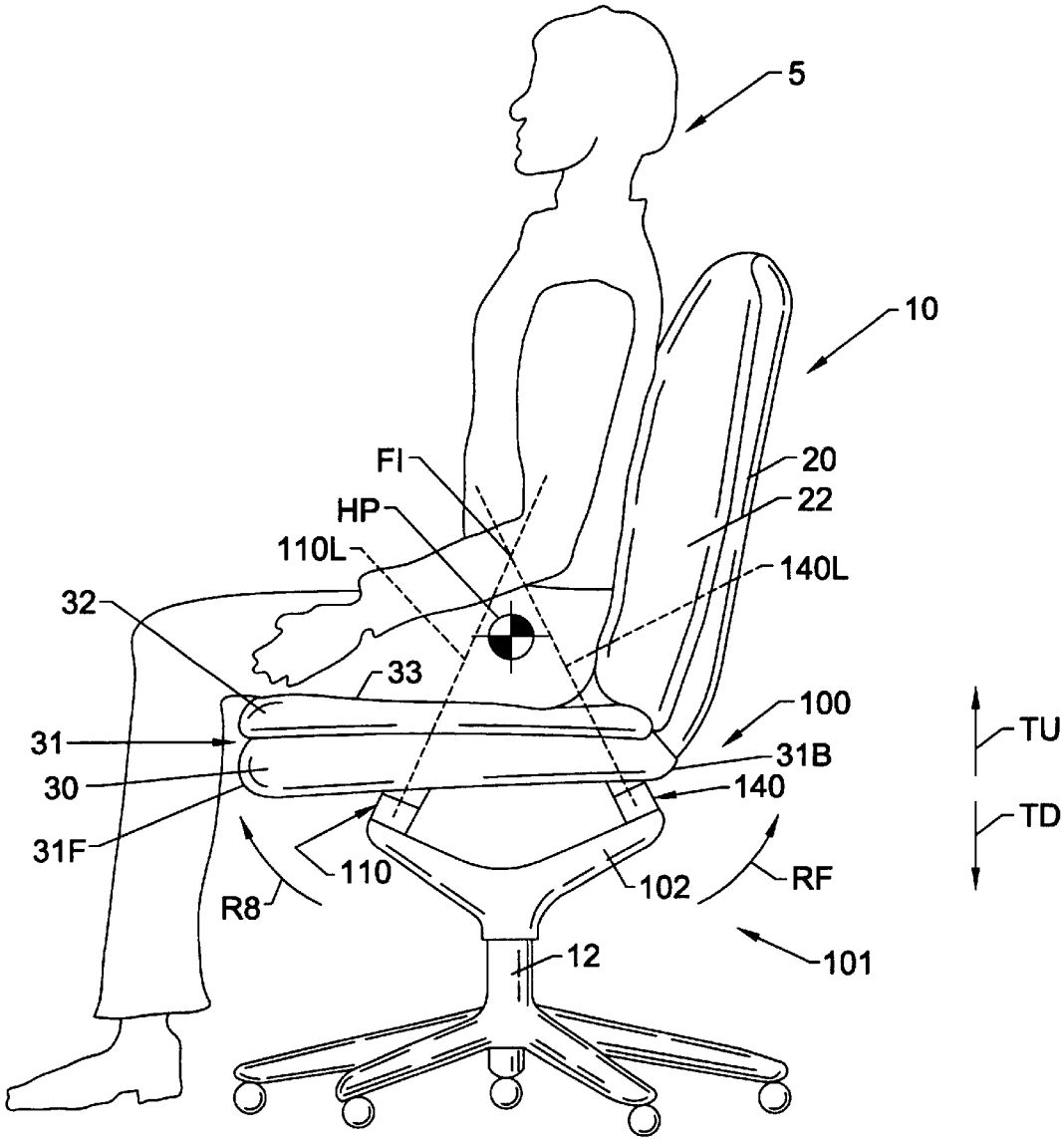
FIG. 1 is a schematic, side view of a chair incorporating a seat suspension system according to the present invention, and a user seated in the chair.

The present invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements throughout.

The terms "elastic center", "projected elastic center", "focal angle" (or "orientation angle"), and "focalized" will be understood by those of skill in the relevant art in view of the description herein. The meaning of the term "elastic center" may be appreciated by reference to a hypothetical suspension system including a plurality of elastic mounts and a body mounted (i.e., elastically suspended) on the elastic mounts. The mounts collectively define a mount plane. The elastic center of the suspension system is a point at which, if the center of mass of the body is located at the point, the application of a force through the point would result in a pure translational movement along the line of the force action, and the application of a moment about the point would result in pure rotation of the body about that point.

The "projected elastic center" and "focalization" of spring members in a suspension system may be appreciated by expansion of the foregoing discussion. Each mount has a respective line of action that defines with the mount plane an angle of orientation or focal angle of the mount. In the simplest arrangement, the lines of action or compression axes are each oriented at 90 degrees to the mount plane so that the lines are parallel and do not intersect, in which case the mounts are not focalized. In this simplest case, the elastic center of the suspension system will be in the mount plane.

In a focalized suspension system, the lines of action of the respective mounts are disposed at focal angles of less than 90 degrees such that the lines of action intersect at a point above the mount plane, i.e., the mounts are focalized. In such case, the suspension system will have a projected elastic center between the mount plane and the point of intersection. That is, the "elastic center" (as described above) of the suspension system is relocated from the mount plane to a plane above or below the mount plane. The location of the projected elastic center will depend on the arrangement of the mounts in the mount plane, the properties of the mounts and the focal angles of the mounts.

It will be appreciated that it is not necessary for a suspension system to have a plurality of individual, discrete mounts in order for the suspension system to have an elastic center or a projected elastic center. Any suspension system will have an elastic center. A single elastic mount may have a shape, location and properties that give the single spring multiple, focalized lines of action which provide a projected elastic center (see FIG. 8). Moreover, although chair embodiments are illustrated herein, it should be recognized that the seat suspension in accordance with the invention may be utilized in a number of vehicle applications, such as for example, in car, truck, tractor, or construction and agricultural vehicle seats.

With reference to FIGS. 1–4, a chair 10, including a seat suspension system 100 according to the present invention, is shown therein. In FIG. 1, a typical user 5 is shown seated in the chair 10. The suspension system 100 includes a seat member 31 upon which the user 5 sits, a base member 102 including a plurality of radially and slightly upwardly extending fingers, and a plurality of elastic mounts 110, 120, 130, 140 interposed therebetween. The chair 10 includes a base support 12 which may be of substantially conventional construction, such as a pedestal, and which may include height adjustment means (not shown), such means being well known in the art. Suitable height adjustment means include a gas spring or bearings as are commonly used in office chairs. The base member 102 is secured to the upper end of the base support 12 by suitable means such as press fit, fasteners and/or welding. The base support 12 and the seat suspension system 100 together form a seat assembly 101.

Figure 2:
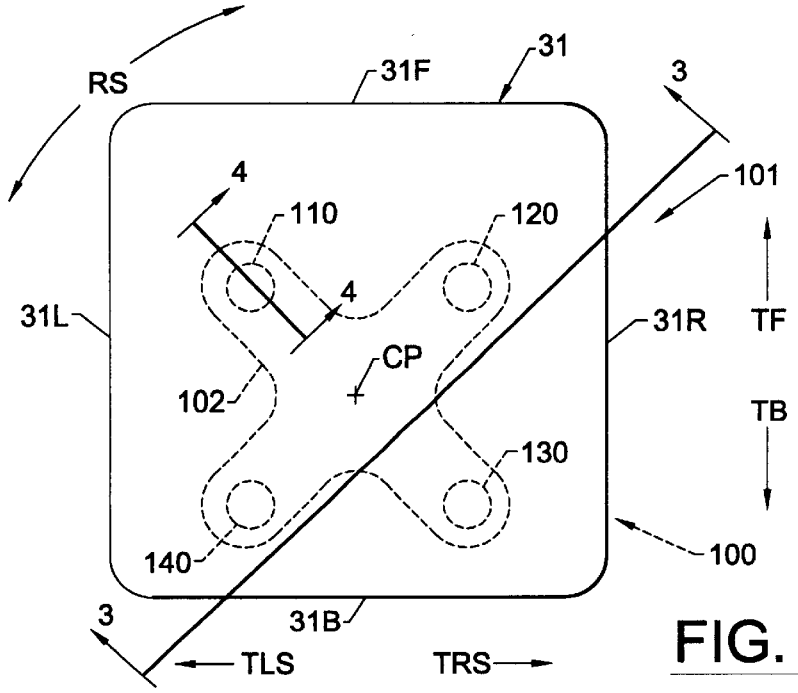
FIG. 2 is a top plan view of a seat assembly forming a part of the chair of FIG. 1.

The seat member 31 includes a seat frame 30 and a seat cushion 32 mounted on the user interfacing side of the seat frame 30. A seatback frame 20 is secured to the seat frame 30. However, it will be appreciated that the seatback frame 20 may also be secured to the base support 12 or the base member 102. Moreover, although not shown, there may be adjustment present between the seat back frame 20 and seat frame 30 as well as a back spring; such constructions being well known to those of ordinary skill in the art. A seatback cushion 22 is mounted on the seatback frame 20. With reference to FIG. 2, is which shows a top plan view of the seat assembly 101, the seat member 31 has a front edge 31F, a back edge 31B, a left edge 31L, and a right edge 31R. Suitable materials and constructions for the seat frame 30, the seatback frame 20 and the cushions 22, 32 (e.g., foam and cloth) will be readily apparent to those of skill in the art. The seat frame 30 and seatback frame 20 are preferably molded, stamped, cast and/or assembled from a substantially rigid material such as steel or plastic.

With reference to FIG. 2, the suspension system 100 includes four spaced apart elastic mounts 110, 120, 130, 140 preferably positioned equidistant from a center point CP and from the adjacent mounts 110, 120, 130, 140. Each of the mounts 110, 120, 130, 140 is preferably of substantially identical construction. Thus, while the mount 130 is not shown in FIG. 3, it will be appreciated that the mount 130 is constructed, arranged and oriented in the same manner as the other mounts which are shown in FIG. 3.

Figure 3:
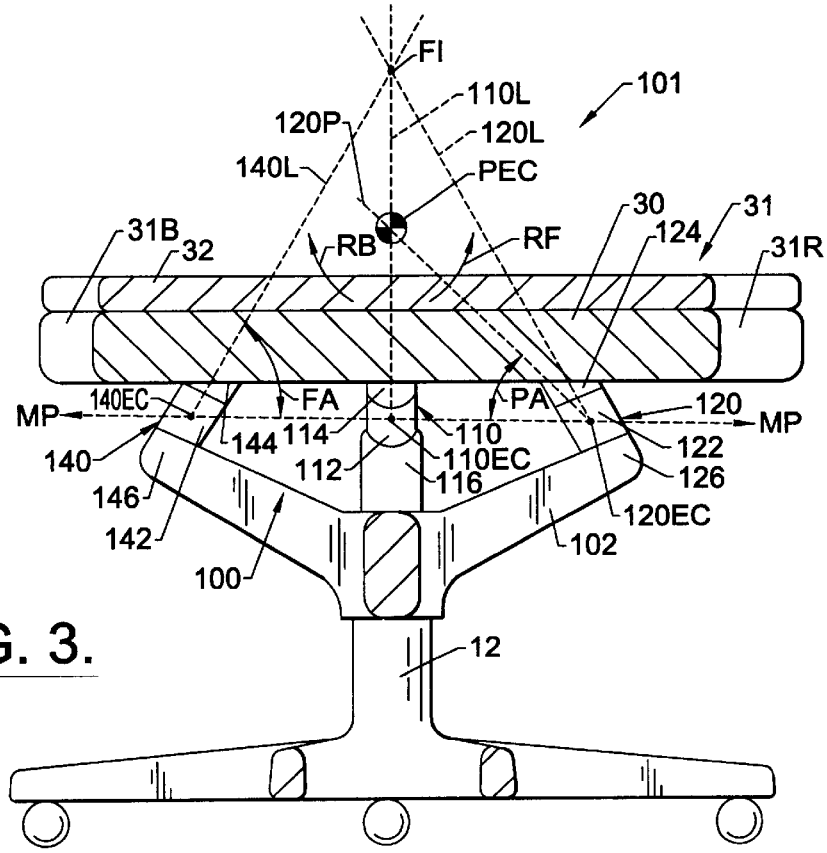
FIG. 3 is a cross-sectional view of the seat assembly of FIG. 1 taken along the line 3—3 of FIG. 2.

With reference to FIG. 3, each of the mounts 110, 120, 130, 140 includes a respective elastomer (elastic) spring 112, 122, 142 which engages a respective upper boss 114, 124, 144, and a respective lower boss 116, 126, 146. The lower bosses 116, 126, 146 may be integrally formed (e.g., by molding, stamping or casting) with the base member 102 or separately formed and secured to (e.g., by fasteners or welding) the base member 102. Likewise, the upper bosses 114, 124, 144 may be integrally formed (e.g., by molding, stamping or casting) with the seat frame 30 or separately formed and secured to (e.g., by fasteners or welding) the underside of the seat frame 30.

Figure 4:
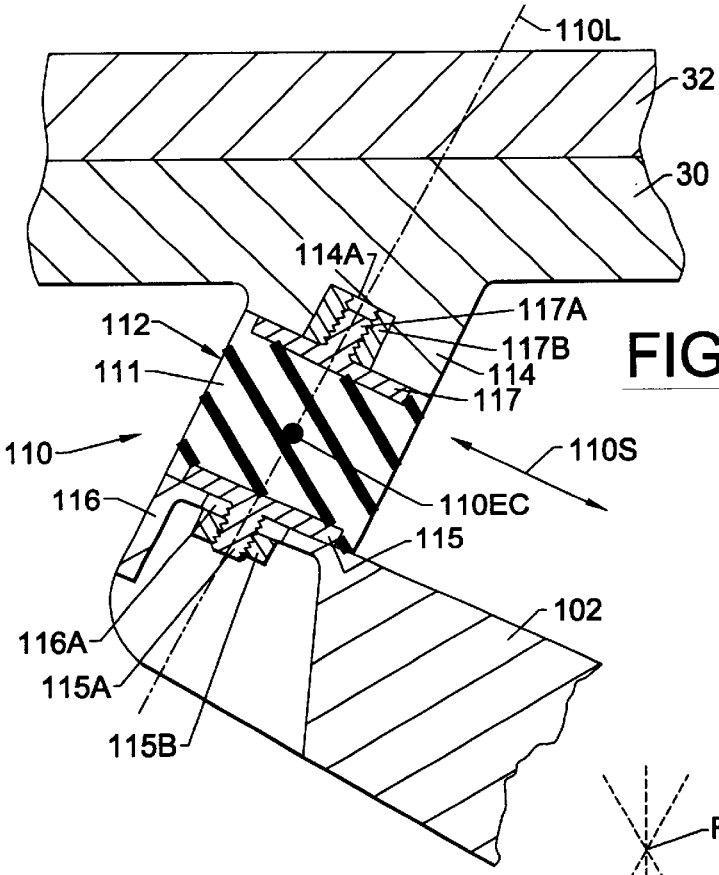
FIG. 4 is an enlarged, fragmentary, cross-sectional view of the seat assembly of FIG. 2 taken along the line 4—4 of FIG. 2.

Preferably, each mount 110, 120, 130, 140 is preferably constructed as shown in FIG. 4 which shows the mount 110 in cross-section. The elastomer spring 112 is an elastomer sandwich mount including a substantially cylindrical elastomer member 111 and planar end plates 115, 117 bonded to either end thereof. The elastomer member 111 is preferably formed of a preferably substantially incompressible resilient rubber-like material such as natural rubber, synthetic elastomers (e.g., silicone, nitrile, neoprene, polybutadiene, TPE, urethane, or the like) or a blends thereof. The end plates 115, 117 may be formed of steel, aluminum, plastic or other suitable rigid material. The end plates 115, 117 are secured to the base member 102 and the seat frame 30, respectively, by integral threaded members 115A, 117A. The threaded member 117A is received in a nut 117B fixedly embedded in a bore 114A, and the threaded member 115A is received through a slot 116A and secured in place by a nut 115B. The slot 116A is elongated to facilitate assembly of the suspension system 100. The mount 110 has a primary compression axis 110L and a shear direction 110S generally perpendicular thereto. The mount 110 also has an individual elastic center 110EC.

With reference again to FIG. 3, each of the mounts 110, 120, 130, 140 has a respective elastic center 110EC, 120EC, 140EC. The four elastic centers define a mount plane MP. A focal angle FA is defined between each compression axis 110L, 120L, 140L and the mount plane MP. The focal angles are all generally the same. The mounts are arranged spatially and geometrically in the mount plane MP and angularly with respect to the mount plane MP such that the compression axes 110L, 120L, 140L (and also the compression axis of the mount 130) intersect at a focal intersection point FI, so that the mounts 110, 120, 130, 140 are focalized. The mounts are arranged such that they present a projected elastic center PEC between the focal intersection FI and the mount plane MP. Each mount 110, 120, 130, 140 has a projected compression axis forming a projection angle PA with the mount plane MP (for clarity, only the projected compression axis 120P (of the mount 120) and its associated projection angle PA are shown, each of the remaining projected compression axes and projection angles being arranged symmetrically with respect thereto.

The projected elastic center PEC is preferably located above the seat member 31 and the mount plane MP is located below the seat member 31. The projected elastic center PEC is the pivot point of movement of the seat member 31 mounted on the mounts 110, 120, 130, 140. Preferably, the projected elastic center PEC approximately coincides with the user's natural hip pivot point HP (see FIG. 1) when the user is seated on the contact surface 33 of the seat member 31 (accounting for compression of the cushion 32). The projected elastic center PEC may be selected to coincide with the location of a prescribed average user's hip pivot, thus approximating the hip pivot point location for a wide range of users of different shapes and sizes. The projected elastic center is preferably located between about 2 and 6 inches (about 50–152 mm) above the seat 31 when the seat cushion 32 is compressed by a user's weight.

The suspension system 100 allows for movement of the seat member 31 with respect to the base support 12 in a number of directions, preferably with varying degrees of resistance as desired. The suspension system 100 allows the seat member 31 to be rotated forward in a direction RF about the projected elastic center PEC (see FIGS. 1 and 3). Similarly, the suspension system 100 allows the seat member 31 to rotate backward in a direction RB about the projected elastic center PEC (see FIGS. 1 and 3). The suspension system 100 allows the seat member 31 to move translationally upward in the direction TU and translationally downward in the direction TD (see FIG. 1). The suspension system 100 allows the seat member 31 to move translationally forward in the direction TF and translationally backward in the direction TB (see FIG. 2) as well as translationally rightward in the direction TRS and translationally leftward in the direction TLS (see FIG. 2). Combinations of the foregoing movements may also be made.

The suspension system 100 may also allow, preferably to a relatively lesser degree, rotational swiveling movement of the seat member 31 in the direction RS about the center point CP which is vertically aligned with the projected elastic center PEC (see FIG. 2). However, it should be recognized that such pivoting in the RS direction will be minimal or nonexistence if a pivot joint is present between the base member 102 and seat base 12.

By way of example and not to be considered limiting, preferable characteristics of the system 100 of FIGS. 1–4, for example, are as follows. Preferably, the pivotal stiffness of the suspension system 100 is in the range of about $K_{RB}$, $K_{RF}$=100–300 in. lb./deg. Likewise, the pivotal stiffness about the fore and aft direction is the same. The rotational pivotal stiffness $K_{RS}$ about the vertical axis is in the range between about 50–150 in. lb./deg. Preferably, the translational stiffnesses are in the range of between about $K_{TF}$, $K_{TB}$, $K_{TLS}$ $K_{TRS}$=80–220 lb./in. The vertical stiffness of the suspension system 100 is in the range of between about 500–1500 lb./in. Preferably, the projected elastic center PEC is located in the range of between about 2–10 inches from the mount plane MP. The mounts 110–140 are preferably sandwich-type mounts having a diameter of about 1.5 inches and a height of about 1.5–2.0 inches and are manufactured from a natural rubber material having a Shore A durometer of about 40 and an L value, where L=compression stiffness/shear stiffness, in the range between about 3–12. The four mountings 110–140 are preferably mounted in a square pattern, are spaced about 10 inches apart, and include a focal angle FA of about 23 degrees. By appropriate design of the mounts and their relative placements, one or more of the aforedescribed movements may be prevented.

The suspension system 100 as described above provides a number of advantages. The suspension system allows multiple degrees of freedom with controlled stiffness and, if desired, snubbing without the use of mechanical pivots or the associated frictional problems and complexity. The suspension system is self adjusting so that it adapts to the user's constantly changing position. Motions of the user's upper and lower body work in a natural fashion. This feature is particularly desirable for applications where the user must remain seated for extended periods of time. The suspension system 100 also reduces the concentration of loads on the user's body. The loads felt on the back and thighs may be particularly minimized. The suspension system is relatively inexpensive to manufacture and to incorporate into various seating assemblies.

The seat suspension system 100 of the present invention may be used in any suitable static or dynamic seating system. For example, the seat suspension may be incorporated in an office chair (as shown) or the like as well as in dynamic isolator seating systems of the types used in cars, trucks and tractors and other vehicles. Methods for incorporating the seating suspension of the present invention into other such seating systems will be apparent to those of skill in the art upon reading the description herein.

Figure 5:
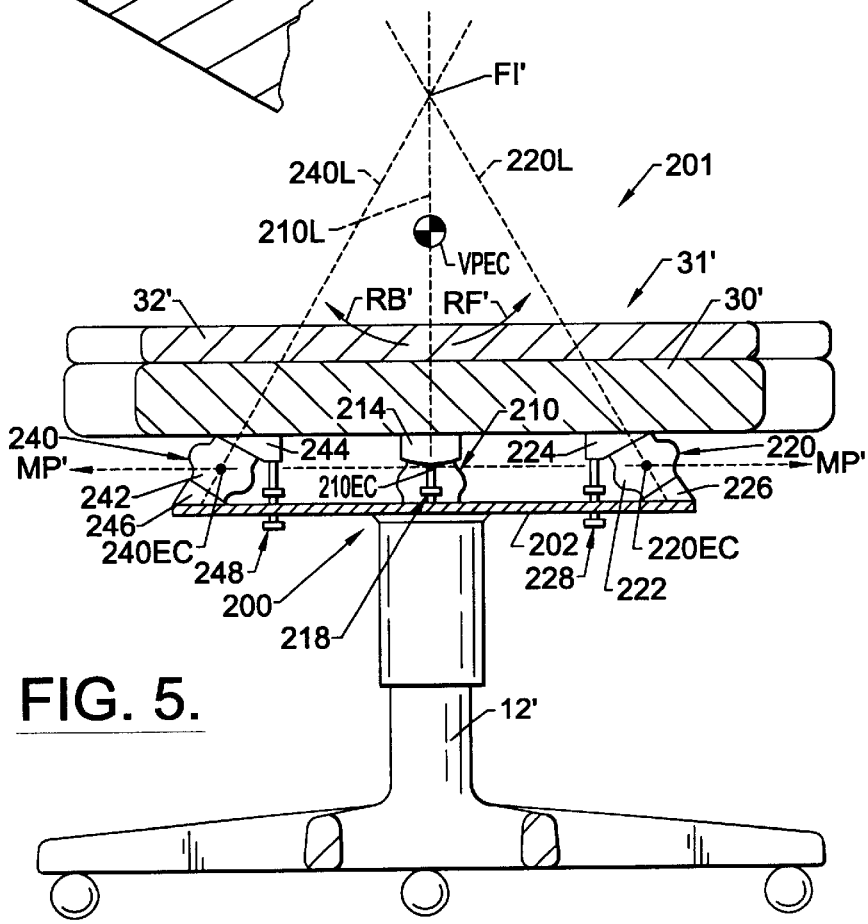
FIG. 5 is a cross-sectional view of a seat assembly according to a further embodiment of the present invention taken along a line corresponding to the line 3—3 of FIG. 2.
Figure 6:
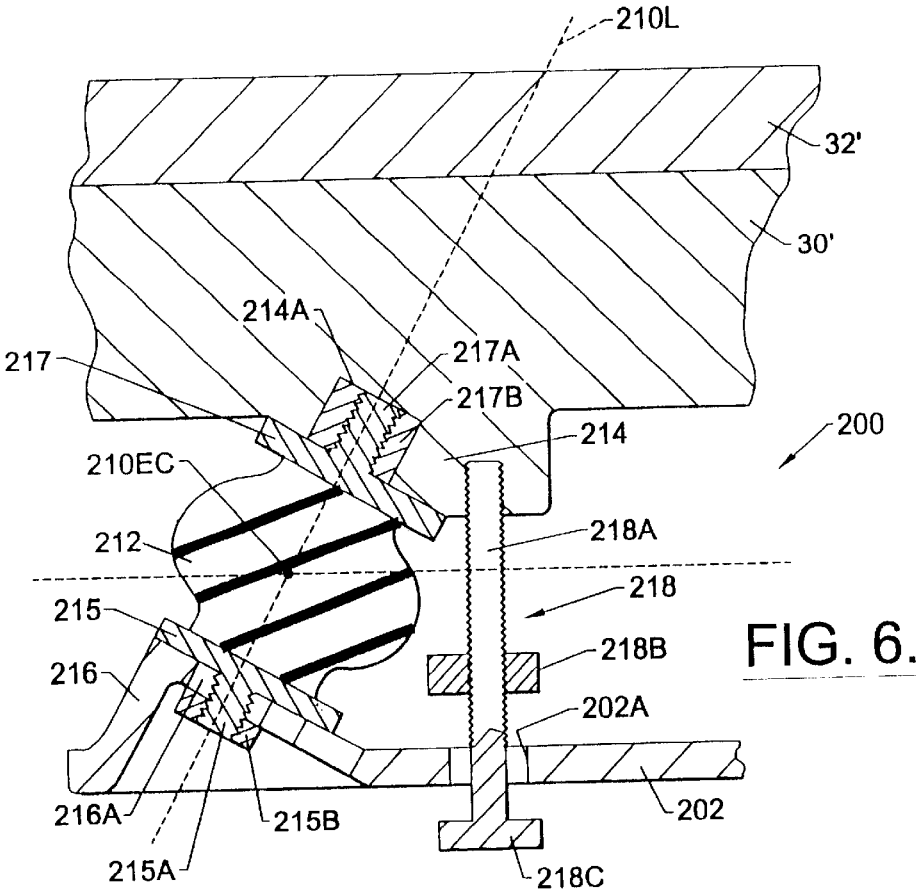
FIG. 6 is a cross-sectional view of the seat assembly of FIG. 5 taken along a line corresponding to the line 4—4 of FIG. 2.

With reference to FIGS. 5 and 6, a seat assembly 201 according to a further embodiment of the present invention is shown therein. The seat assembly 201 may be incorporated into a chair in the same manner as the seat assembly 101. The seat assembly 201 includes a base support 12' and a seat suspension system 200 mounted thereon in the manner described above. FIG. 5 shows a cross-sectional view of the seat assembly 201 along a line corresponding to the view of FIG. 3. The suspension system 200 includes a planar base member 202 and a seat member 31' including a seat frame 30' and a cushion 32'. The suspension system 200 further includes four elastic mounts 210, 220, 240 (the fourth mount corresponds to the mount 130 and is not shown in FIG. 5) arranged in the same manner as in the suspension system 100. Each mount 210, 220, 240 engages an upper boss 214, 224, 244 of the seat frame 30' and a lower boss 216, 226, 246 of the base member 202. The elastic centers 210EC, 220EC, 240EC of the respective mounts define a mount plane MP'.

With reference to FIG. 6, the suspension system 200 differs from the suspension system 100 in the construction of the mounts 210, 220, 240 (as well as the fourth, unillustrated mount) and in the provision of stop assemblies 218, 228, 248. The system 200 includes a fourth stop assembly associated with the fourth mount, which is not shown in the figures. FIG. 6 shows only the mount 210 and the associated stop means 218. However, it will be appreciated that the remaining stop assemblies 228, 248 are formed in the same manner.

The mount 210 is a Lastosphere®-type mount including an elastomer member 212 and end plates 217, 215 vulcanized bonded to either end of the elastomer member 212. The end plates 215, 217 are secured to the base member 202 and the seat frame 30' by threaded shafts 215A, 217A. The threaded shaft 217A engages a nut 217B embedded in a bore 214A, and the shaft 215A extends through a slot 216A in the boss 216 and is secured by a nut 215B. The elastomer member 212 is generally spherical and shaped such that as the mount is compressed along its compression axis 210L, its stiffness in compression increases non-linearly, and more particularly, more rapidly than in the case of, for example, the cylindrical mount 110. This characteristic is attributable to the increased load area between the elastomer member 211 and the end plates 215, 217 as the elastomer member 211 is compressed.

In use, the mounts 210, 220, 240 (FIG. 5) enable the suspension system 200 to automatically adjust the location of the apparent pivot point of the seat member 31. The compression axes 210L, 220L, 240L of the mounts 210, 220, 240 are focalized to intersect at the focal intersection FI', thereby providing a projected elastic center VPEC above the seat plane SP'.

In the case of the suspension system 200, the projected elastic center VPEC may be referred to as a variable projected elastic center. Because the compression stiffnesses of the mounts 210, 220, 240 increase more rapidly than linear, the variable projected elastic center VPEC rises vertically with respect to the mount plane MP' as the mounts are compressed. That is, the greater the compressive displacement of the mounts 210, 220, 240, the higher above the mount plane MP' the variable projected elastic center VPEC will reside. This behavior allows the suspension system 200 to correct for the size of the user. Typically, those users having greater mass also have a slightly greater distance between their lower seating surface and their hip pivot line. Users of greater mass will compress the mounts 210, 220, 240 a greater distance, thereby raising the variable projected elastic center VPEC to coincide with their relatively higher hip pivot line. Accordingly, the seat member 31' will pivot about a higher pivot point, for example, when rotating along the directions RB' and RF'.

With reference to FIG. 6, the stop assembly 218 includes a screw 218A having a head 218C. The upper end of the screw 218A is threadedly secured to a portion of boss 214. The lower end of the screw 218A extends through a hole 202A formed in the base member 202. The hole 202A is large enough to allow lateral and forward/aft movement of the screw 218A, as needed, to allow pivoting and translational motion of the seat member 31' through its designed ranges of motion. A nut 218B threadedly engages the screw 218A so that its position along the screw 218A may be selectively adjusted. The screw 218A may slide up and down as the seat frame 30' is displaced relative to the base member 202 as the seat frame 30' pivots. The head 218C is larger than the hole 202A and serves as a stop to limit upward displacement of the seat frame 30' relative to the base member 202. Similarly, the nut 218B is larger in diameter than the hole 202A and serves as a stop to limit downward displacement of the seat frame 30' toward the base member 202. It will be appreciated by those of skill in the art upon reading the description herein that other means for providing a stop or limiter may be employed. Such other means may include, for example, fixed or position adjustable elastic bumpers.

Figure 7:
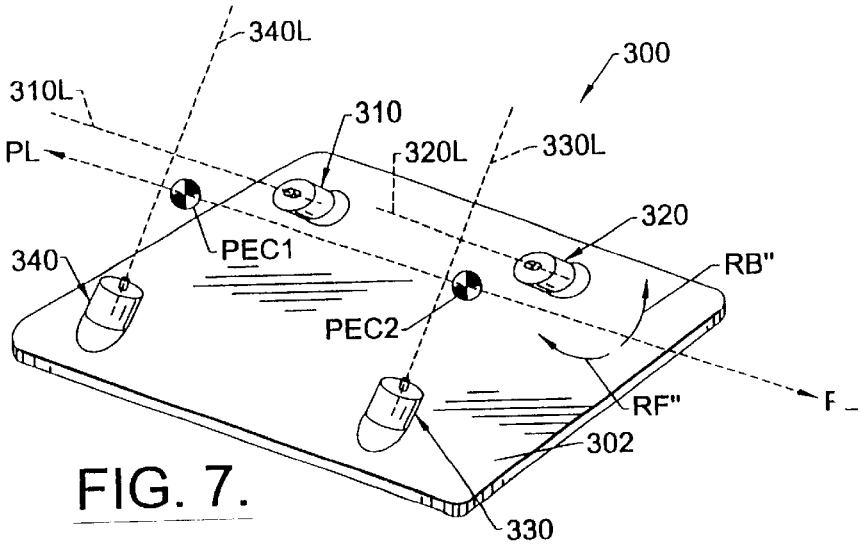
FIG. 7 is a perspective view of a partial seat suspension system according to a further embodiment of the present invention.

With reference to FIG. 7, a seat suspension system 300 according to a further embodiment of the present invention is shown in part therein. The seat suspension system 300 corresponds to the suspension system 100 except for the orientation of the mounts 310, 320, 330, 340. For clarity, the upper bosses corresponding to the bosses 114, 124, 144 are not shown in FIG. 7. The compression axes 310L and 340L of the mounts 310 and 340 are focalized to present a first projected elastic center PEC1. The compression axes 320L and 330L of the mounts 320 and 330 are focalized to present a second projected elastic center PEC2. A pivot axis PL extends through both the projected elastic center PEC1 and the projected elastic center PEC2. In this way, the suspension system 300 provides primarily a line pivot rather than a pivot point. Preferably, the pivot axis PL coincides with the user's fore and aft hip pivot line. Thus, pivoting is primarily allowed in a forward pivot direction RF" and a backward pivot direction RB". Some further limited pivoting may be allowed in other directions.

While the foregoing seat suspension systems preferably use identical mounts arranged in bilaterally symmetric arrangements, the present invention may be practiced using mounts having different orientations, positioning, stiffnesses, and static and dynamic behaviors. Moreover, the mounts may be arranged in other symmetric and non-symmetric arrangements in the mount plane. A lesser or greater number of mounts may be used. Moreover, the present invention suspension may be employed on other chair components such as seatbacks, arms, pedestal base, etc. For example, the suspension system may be utilized to support and focalize, for example, a seatback wherein the projected elastic center would substantially with the location of the user's spine coincide. Alternatively, the seat back pivot point may be focalized such that the projected elastic center is about the hip line pivot (a line through the hip joints). A system such as shown in FIG. 7 may be employed to accomplish focalization of the seatback.

Figure 8:
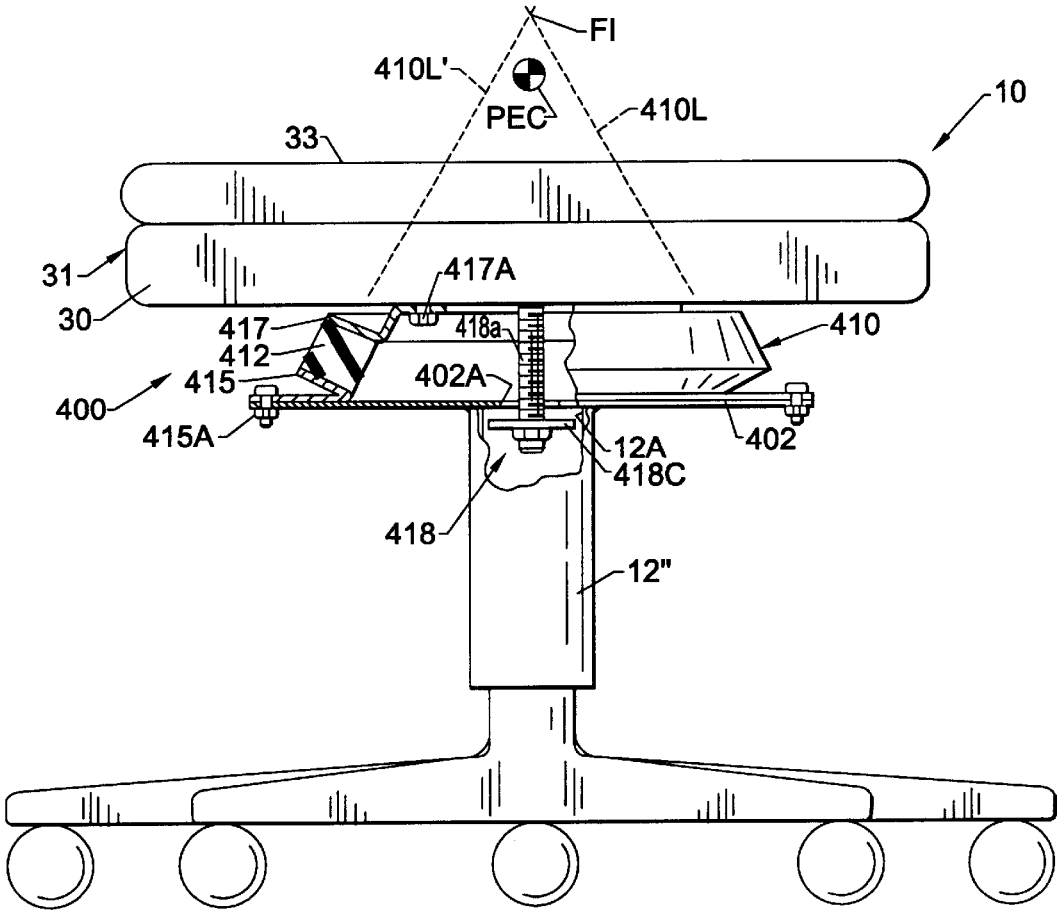
FIG. 8 is a perspective view of a seat suspension system including a single focalized mount in accordance with the present invention.

As illustrated in FIG. 8, a single conical mount providing a projected elastic center PEC is illustrated. FIG. 8 illustrates a chair 10 (as previously described), including a seat suspension system 400 according to the present invention. The typical user will interface with a contact surface 33 of the chair 10 on a user contact side of a first (e.g., a seat) seat member 31. A second seat (e.g., a base) member 402 is spaced apart from the first, and a single elastic mount 410 is preferably interposed between the first 31 and second 402 seat members. The mount 410 in this embodiment includes first and second rigid members 415, 417 which are preferably stamped and bent metal plates, and an intervening frustoconical elastic member 412. The frustoconical elastic member 412 is preferably formed of elastic material such as natural or synthetic rubber or blends thereof, bonded to the conical surfaces of both the rigid members 415, 417. Members 415, 417 are secured to first and second seat members 31, 402 by suitable fasteners 415A, 417A. Alternatively, elastic member 412 may be bonded or otherwise adhered directly to conical boss surfaces formed on frame 30 of first member 31 and on the second seat member 402. The projected elastic center PEC of the elastic mount 410 is preferably located above the first seat member 31 and somewhat spaced from the contact surface 33 on the user interface side of the first member 31. As indicated before, it is preferable that the position of the projected elastic center PEC substantially coincides with the hip pivot of the user (see FIG. 1). The respective lines of action 410L, 410L' at any cross-sectional slice through the conical mount 410 intersect as previously described to form the focal intersection point FI. Although a conical mount is illustrated, it should be recognized that other mounting configurations with focalized elastic centers may be employed. For example, spherical thrust-type mounts, i.e., mounts including spherical portions, may be used as an alternative by incorporated partial spherical surfaces on members 415, 417 with the spherical center focalized above the first seat member 31.

As in the previous embodiments, a stop assembly 418 may be provided to limit any desired motion of the first seat member 31 relative to the second 402. The stop assembly 418 may include a threaded rod received through hole 402A and having a stop 418C mounted thereon. The washer-like stop 418C contacts with the inner surface 12A of pedestal 12" to limit pivotal motion of the first seat member 31 and also safeties the suspension system 400 as the stop 418C is larger than the hole 402A.

Seats incorporating a seat system according to the present invention may be constructed such that the elastic mounts are either shrouded or entirely visible. If left visible, the elastic members may be color matched (e.g., through appropriate compounding of the elastomer) to the color of the cushions.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A seat assembly, comprising:

a) a seat member;

b) a base support connected to and underlying said seat member; and c) a single conical mount interposed between said seat member and said base support, said single conical mount having a frustoconical elastic member, said single conical mount frustoconical elastic member having a plurality of inwardly angled lines of action through cross-sectional slices of the mount with the inwardly angled lines of action intersecting at a focal intersection point above the seat member such that said seat member is pivotable about a pivot point located above said seat member.

* * * * *